United States Patent [19]

Farr et al.

[11] Patent Number: 4,604,614

[45] Date of Patent: Aug. 5, 1986

[54] VIDEO DISPLAY SYSTEM EMPLOYING PULSE STRETCHING TO COMPENSATE FOR IMAGE DISTORTION

[75] Inventors: Robert W. E. Farr, Allbrook; Ian D. Judd, Chandler's Ford, both of England

[73] Assignee: International Business Machines Corp., Armonk, N.Y.

[21] Appl. No.: 536,116

[22] Filed: Sep. 26, 1983

[30] Foreign Application Priority Data

Sep. 29, 1982 [EP] European Pat. Off. ..... 82305176.8

[51] Int. Cl.[4] ..... G09G 1/06

[52] U.S. Cl. ..... 340/728; 340/723; 340/732; 340/744; 340/814

[58] Field of Search ..... 340/723, 728, 732, 733, 340/736, 742, 744, 748, 801, 804, 805, 812, 814; 315/383, 384, 385

[56] References Cited

U.S. PATENT DOCUMENTS

| | | | |
|---|---|---|---|
| 4,040,088 | 8/1977 | Hannan . | |
| 4,215,414 | 7/1980 | Huelsman | 340/728 |
| 4,393,378 | 7/1983 | Danielsen et al. | 340/814 |

OTHER PUBLICATIONS

IBM Technical Disclosure Bulletin, vol. 17, No. 11, Apr. 1975; pp. 3325–3327; M. Nasser et al; Correction of Phase Distortion in a Television Receiver when Used for Character Display Purposes.

IBM Technical Disclosure Bulletin, vol. 17, No. 11; 4/75; pp. 3323–3324; M. Nasser et al., "Correction of Amplitude Distortion in a Television Receiver when Used for Character Display Purposes".

IBM Technical Disclosure Bulletin, vol. 24, No. 11B, Apr. 1982—B. O. Chase—"Pulse Stretching for CRT Display Visibility", pp. 5794–5795.

*Primary Examiner*—Gerald L. Brigance
*Assistant Examiner*—Jeffery A. Brier
*Attorney, Agent, or Firm*—Frederick D. Poag

[57] ABSTRACT

In order to compensate for image distortion introduced into a digitally-controlled raster-scan CRT by the finite video amplifier rise and fall times, the digital video drive waveform is subject to selective pulse stretching to extend where possible the duration of pels which represent critical features of the image. This is achieved by decoding means for examining each pel at least in relation to its two immediate neighbors on either side in order to detect predetermined relationships between the values of the pels, and retiming means for selectively advancing or delaying the transitions between consecutive pels of different value in accordance with the relationships so detected.

In one embodiment, suitable for multibit or single bit video, the decoding means comprises means (40, 25) for comparing each pel with its immediate successor, a shift register (26 to 28) for storing the result of each comparison together with the results of a plurality of immediately preceding comparisons, and a logic circuit (30 to 33) connected to the shift register stages, and the retiming means comprises a delay path (41 to 44) for the waveform having an output register (44) and means (34 to 39) responsive to the logic circuit for clocking the output register at a predetermined time in relation to non-selected transitions, earlier than the said predetermined time in relation to transitions selected for advancement, and later than the said predetermined time in relation to transitions selected for delay.

4 Claims, 3 Drawing Figures

VIDEO DISPLAY SYSTEM EMPLOYING PULSE STRETCHING TO COMPENSATE FOR IMAGE DISTORTION

BACKGROUND OF THE INVENTION

1. Field of the Invention

This invention relates to a video display system of the kind in which at least one visible characteristic of consecutive image points on the screen of a raster-scan CRT is defined by the values of consecutive pels of a digital video drive waveform, each such pel comprising one or a plurality of video bits in parallel, and in which a pulse stretching circuit is provided for extending the duration of selected pels in the video waveform in order to at least partially compensate for image distortion introduced by the finite video amplifier rise and fall times of the CRT. A system of this kind is described in IBM TDB, Vol. 24, No. 11B, page 5794 and is used in the IBM 8775 terminal.

2. Description of the Prior Art

The video channel of a high content raster-scan CRT display must operate at a very fast data rate if flicker is to be avoided. For example, a data display having 1.2 million image points refreshed at 60 Hz with a non-interlaced raster requires a peak data rate of about 100 Mpels/Sec. This corresponds to a pel period of 10 nSecs. Full modulation of the electron beam requires a cathode drive voltage of about 35 volts for a monochrome tube and up to 60 volts for color. It is very difficult to design a video amplifier to produce these voltage transitions in a time which is short compared to the pel period. This is particularly true if the amplifier must handle analog signals rather than a simple binary waveform. In this case 10 to 90% rise and fall times of 7 nSecs are considered state-of-the-art for a color display. Such an amplifier will produce greatly distorted video pulses compared to the ideal rectangular shape. For the user the effect is particularly noticeable on vertical strokes which have much reduced contrast if they are only one image point wide. The problem is most severe with a monochrome bright-on-dark display (hereinafter referred to as a white-on-black display for convenience) because the beam current is proportional to the drive voltage raised to a power gamma, where gamma is typically 2.2. Consequently, the contrast of a single image point is effectively related to the drive pulse width measured near the voltage for peak white and this is only a few nSecs for a white pulse with the figures quoted.

One known solution to this problem, used in white-on-black displays and referred to above, is to extend the trailing edge of positive (white) pels by logically OR'-ing the video waveform with a delayed version of itself. Obviously this technique lengthens positive pels by shortening negative ones and as such is unsuitable for displays having mixed white-on-black and black-on-white information. This problem can be overcome in the restricted case when all the information in a particular region of the display screen is known by the system to have the same polarity. In this case the video signal can be inverted before and after the basic pulse stretching circuit by two exclusive OR gates fed with a signal indicating the information polarity.

However, this technique has several major drawbacks for highly dense displays. In order to cope with mixed polarity displays of high density the system itself must have knowledge of the polarity of the display in each region of the screen. However, even where the polarity is known a highly dense display would have a significant number of image points of opposite polarity to the main information which are isolated in the raster scan direction, and such points would inevitably be reduced in width by the automatic delay of the trailing edge of the immediately preceding pel. Also, the technique cannot be extended to displays with several bits per pel.

SUMMARY OF THE INVENTION

Thus it is an object of the present invention to provide an improved display system of the above kind in which the above drawbacks may be mitigated.

This is achieved according to the invention by providing that the pulse stretching circuit comprises decoding means for examining each pel at least in relation to its two immediate neighbors on either side in order to detect predetermined relationships between the values of the pels, and retiming means for selectively advancing or delaying the transitions between consecutive pels of different value in accordance with the relationships so detected.

In the embodiments of the invention to be described the decoding means only examines the relationship of each pel to its two immediate neighbors on either side, and together with the retiming means operates such that each pel transition selected for retiming is immediately preceded or succeeded by at least two consecutive identical pels, the retiming being effected by advancing or delaying the transition according to whether the said two consecutive pels precede or succeed the transition.

However, the invention is clearly not restricted to this simple case, and by presenting more pels for examination at any one time by the decoding means (i.e. looking further ahead and further behind each pel), by defining more complex relationships for detection which take into account relative changes in pel value rather than simply whether they differ or not, and by providing the re-timing means with the capability of variable advancement or delay of pel transitions, it is clearly possible to compensate for image distortion in both color and black and white to an increasing degree of sophistication, the only limitation being the cost of the circuitry involved.

For example, in the simple case referred to above the retiming means would not extend the trailing edge of a single white pel followed by a single black pel followed in turn by at least two consecutive white pels, since the decoding means would not "see" two consecutive identical pels following the trailing edge of the single white pel. Nevertheless, such edge can in fact be delayed without detriment to the display since the trailing edge of the following black pel will be delayed, being itself followed by two white pels. This situation could be detected simply by examining each pel in relation to its three following pels and decoding accordingly, and a similar procedure could be applied to the leading edge of the pel.

The advantage of the invention is that pels are selected for extension only as a function of their relationship to neighboring pels, so that isolated pels of substantially different color and/or intensity to their neighbors can be identified, at least maintained at their nominal width, and where possible increased in width. This contrasts with the prior art where the pels selected for extension are simply all those pels of a given value in any region of the screen, irrespective of the values of and the effect on neighboring pels. Furthermore, in the invention the individual value of the selected pels is not necessarily a factor in their selection, except insofar as it relates to the values of neighboring pels, so that in any area of the screen pels of any value can be extended. Furthermore, such extension may be in respect of the leading edge as well as or alternatively to the trailing edge, giving each selected pel three possibilities for extension compared to the prior art where only the trailing edges are extended. Finally, the invention operates completely automatically on the video waveform, requiring no prior system knowledge of the polarity of the display, and is equally applicable to both multi-bit video and single bit (black and white) video, whereas the prior circuit is only capable of handling the latter.

We have found that, even in the simple case described above, the present invention provides substantially improved visual results for highly dense or mixed video pictures, and considerably enhances the front-of-screen performance of the display system compared to the existing technique.

BRIEF DESCRIPTION OF THE DRAWINGS

Embodiments of the invention will now be described, by way of example, with reference to the accompanying drawings, in which.

DETAILED DESCRIPTION

Figure 1:
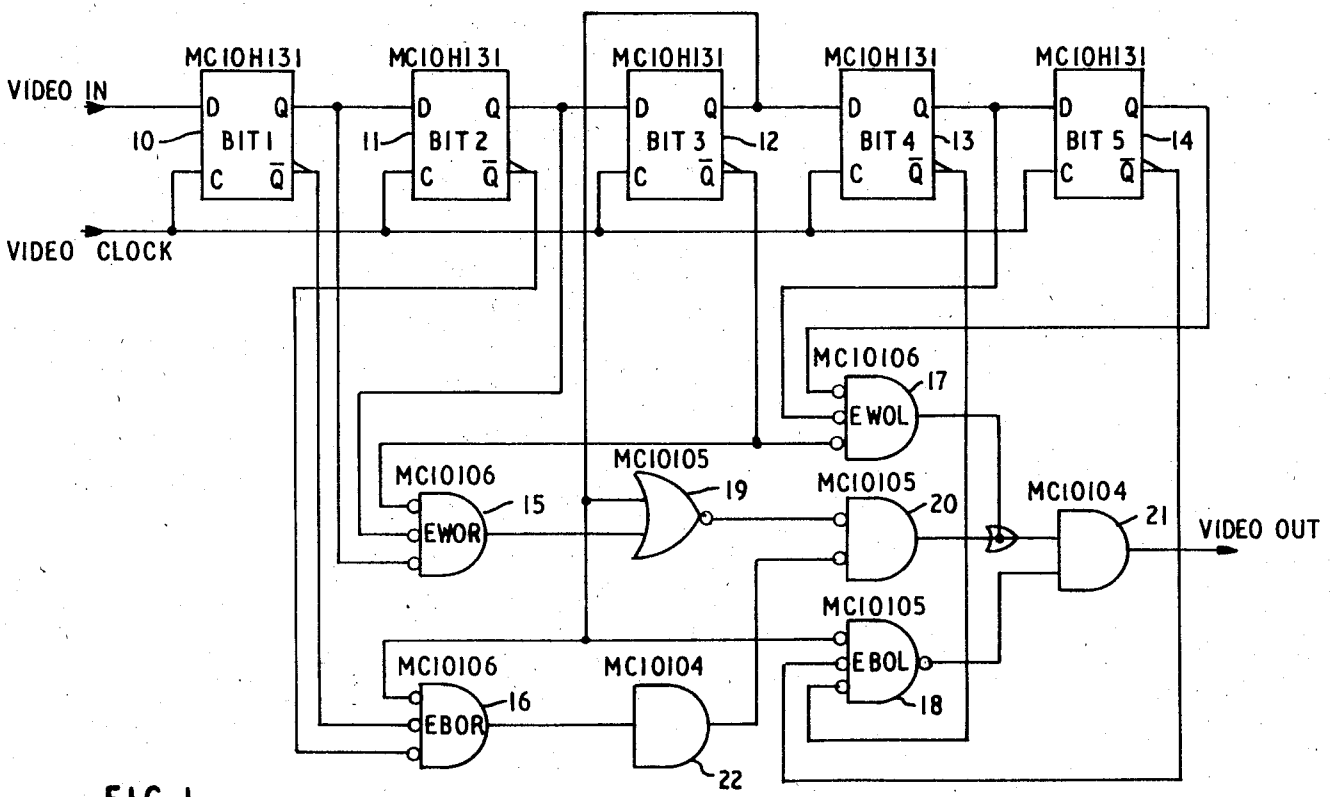
FIG. 1 is a block circuit diagram of a first embodiment of pulse stretching circuit for use in a single bit per pel black and white display system.

The manner in which a digital video waveform is used to drive a raster-scan CRT (cathode ray tube) is well known in the computer graphics art, and may be found in many textbooks on the subject and also in commercially available products such as the above-mentioned IBM 8775 terminal. It is, therefore, not thought necessary to provide details of this aspect of the system, but rather to concentrate on the pulse stretching circuit wherein the present invention lies.

The present invention overcomes the limitations of the prior art above by extending critical features of the video waveform only where there is space (in the time domain) to do so. For a binary (black and white) signal the critical features of interest are simply isolated black pels and isolated white pels. Color and gray-scale displays will be considered later.

The operation of this principle for a binary signal will be explained with reference to the practical implementation shown in FIG. 1. The recognition of critical features is performed by passing the video waveform through a 5-stage shift register formed by a series of five D-type flip flops 10 to 14, the outputs of the shift register being connected to a logic circuit including four 3-input AND gates 15 to 18. The shift register stages are members of the Motorola MECL 10KH series of emitter coupled logic, and the logic circuit components are members of the Motorola MECL 10K series of emitter coupled logic. The latter are selected to have a nominal propagation delay of 2 nSec. The function of each logic component, as indicated by its symbolic representation, is derived from an IC module of the type number shown above each. For clarity all of the emitter pull-down resistors are omitted. Assuming that a white pel is represented by a binary '1' and 'X' means 'don't care', the four gates 15 to 18 decode the following actions:

| Shift register bits (pels) | | | | | |
|---|---|---|---|---|---|
| 1 | 2 | 3 | 4 | 5 | Action |
| X | X | 1 | 0 | 0 | Extend white on left (EWOL) |
| X | 0 | 0 | 1 | 0 | Extend white on right (EWOR) |
| X | X | 0 | 1 | 1 | Extend black on left (EBOL) |
| X | 1 | 1 | 0 | 1 | Extend black on right (EBOR) |

It will be understood that the CRT which is driven by the waveform has a left to right scan, so that EWOL and EBOL refer to the leading edge of a white or black pel, and EWOR and EBOR refer to the trailing edge. In the shift register, therefore, bit 5 is the earliest pel and bit 1 the most recent.

It will be seen that each line of the above truth table detects a transition, at the output of shift register stage 12, with at least two consecutive pels of the same polarity immediately on one side or the other. This indicates that there is space to shift the transition in that direction.

When there is no match in the table the transition (if any) at the output of shift register stage 12 is transmitted to the video output in its nominal position through three logic gate delays, i.e. via gates 19, 20 and 21. When a match in the table indicates that the transition can be shifted to the left, i.e. the leading edge of pel 3 advanced, the transition is transmitted earlier to the video output through two gate delays, i.e. through gates 17 and 21 for EWOL and gates 18 and 21 for EBOL. Finally, when a match indicates that the transition can be extended on the right, i.e. the trailing edge of pel 4 delayed, the transition is transmitted later to the output through four gate delays, i.e. through gates 15, 19, 20 and 21 for EWOR and gates 16, 22, 20 and 21 for EBOR.

The result is that the leading edges of isolated pels preceded by at least two pels of opposite polarity are advanced by 2 nSec relative to their nominal position, whereas the trailing edges of isolated pels succeeded by at least two pels of opposite polarity are delayed by 2 nSec. Since the nominal pel duration is 10 nSec each such pel is extended in duration to 12 or 14 nSec, according to whether the pel has two pels of opposite polarity on only one side or on both sides.

Figure 2:
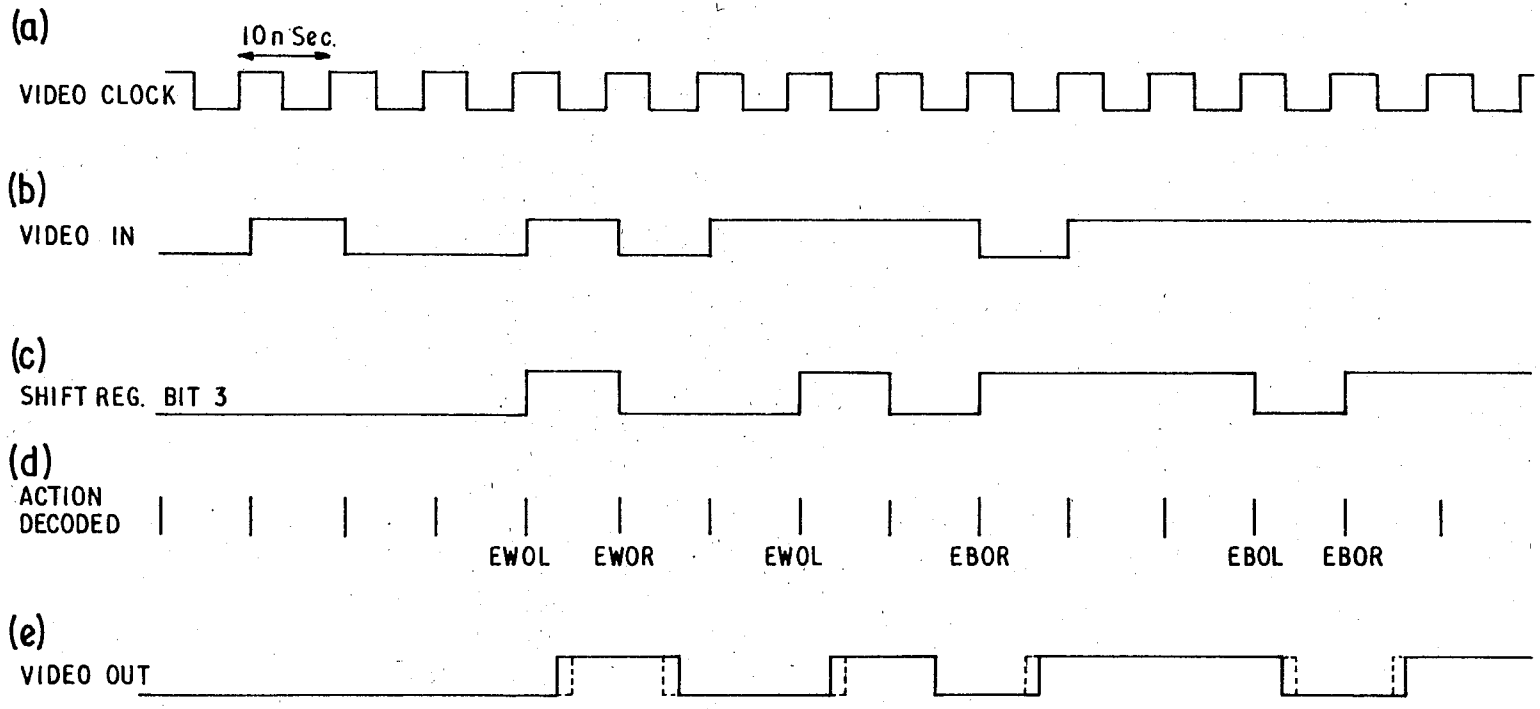
FIG. 2 illustrates typical waveforms and actions occurring during operation of the circuit of FIG. 1.

A typical example of the operation of the above circuit is illustrated by the waveforms of FIG. 2. In FIG. 2, line (a) is the video clock signal having a period of 10 nSec which clocks the video waveform, line (b), into the shift register. The transitions at the output of shift register stage 12 are shown in line (c) and the actions decoded by the AND gates 15 to 18 are shown in line (d). The resulting pulse-stretched waveform is shown in line (e), delayed as a whole by 6 nSec (three gate delays) relative to the waveform at the output of shift register stage 12, but with selected pel transitions advanced or delayed by 2 nSec relative to their nominal positions. The dotted lines in waveform (e) show the original transitions in order to emphasize the effect of the pulse-stretching circuit.

The implementation of FIG. 1 does not have the facility to adjust the amount by which output transitions are shifted. However, this could easily be added. For example, if a choice of two time shifts were desired the nominal delay would be increased to 4 gates, alternative paths of 3 or 2 gates would be provided for left shifts and alternative paths of 5 or 6 gates provided for right shifts.

For the design to function correctly the logic technology should cause no pulse distortion in itself, i.e. the propagation delays for low-to-high and high-to-low output transitions should be equal. Emitter-coupled logic fulfills this requirement well since it operates the transistors out of saturation. The above circuit has been tested at a rate of 100 Mpels/Sec on a monitor with a video amplifier rise time of 7 nSec. The results on displays having a mixture of black-on-white and white-on-black characters and vectors are excellent, being universally superior to those produced by the prior art pulse stretching circuit, in some cases dramatically so. The position is not quite so good for half-tone images of continuous-tone originals. Although one half-toning algorithm gives results which are at least as pleasing as the prior art, another gives poor quality. Thus the facility to by-pass the pulse stretching circuit would be desirable. Alternatively, some half-toning algorithms can easily be modified to compensate for the (intentional) distortions introduced by the pulse stretching circuit, e.g. those using the "error carry" principle.

In the extension of the above technique to color and gray-scale displays in which a picture element is represented by several bits in parallel, it is not sufficient to merely use multiple copies of the circuit of FIG. 1, one for each video bit, since the circuits would each see a different data pattern and shift the transitions between bits independently. On a color display, for example, this would give a visual impression similar to that of misconvergence. This problem can be avoided by making a single decision on the basis of changes of ordinal value in the pel stream and then time-shifting all of the video bits comprising a pel together.

Figure 3:
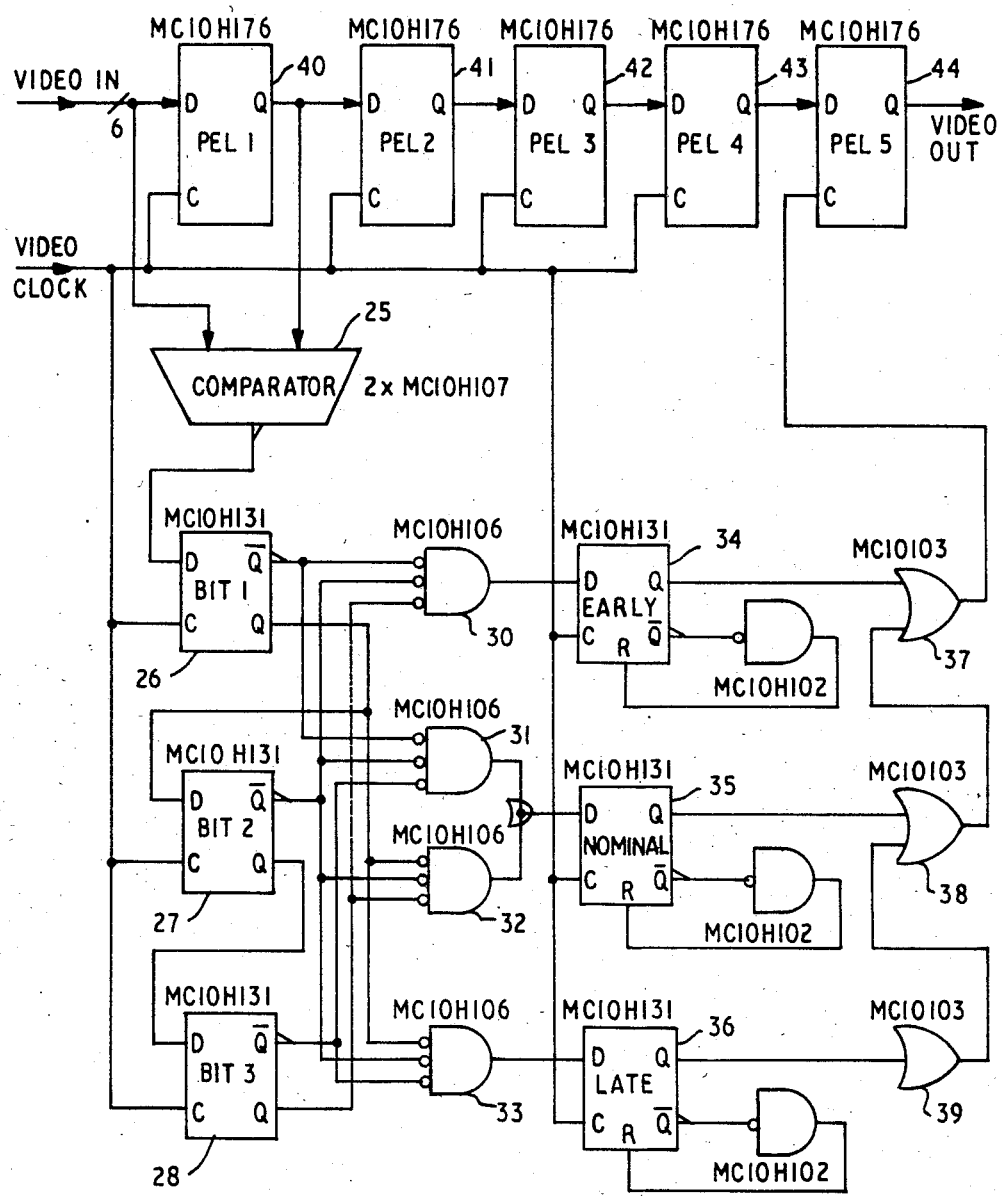
FIG. 3 is a block circuit diagram of a second embodiment of pulse stretching circuit for use in a multi-bit per pel gray scale or color display system.

FIG. 3 shows a practical design using this idea which processes six parallel video bits. Again, Motorola MECL 10K and 10KH modules are used of the type number shown. The video input is applied to a five-stage shift register 40 to 44. The first four stages 40 to 43 of the shift register are clocked by a common video clock signal as shown, whereas the output stage 44 is clocked in response to the decoding of certain pel patterns as will be described. A comparator 25, comprising six XOR gates, compares the value of each pel at the input to the shift register with the value of the immediately preceding pel present at the output of the first shift register stage 40. The comparator 25 provides a binary '1' when the pel currently at the input to the shift register differs in value from its predecessor, otherwise it provides a binary '0'.

The result of each comparison is entered into the first stage 26 of a three-stage shift register 26 to 28 which is clocked by the same clock signal as the shift register stages 40 to 43. The shift register 26 to 28 therefore keeps a running history of the result of the current comparison together with the results of the preceding two comparisons. A logic circuit comprising four 3-input AND gates 30 to 33 is connected to the shift register stages 26 to 28. The AND gates decode the following actions:

| Shift Reg. bits | | | Corresponding pels | | | | |
|---|---|---|---|---|---|---|---|
| 1 | 2 | 3 | 1 | 2 | 3 | 4 | Action |
| 1 | 1 | 0 | n | m | n | n | Extend pel 2 on left |
| 1 | 1 | 1 | m | n | m | n | Make nominal transition |
| 0 | 1 | 0 | m | m | n | n | Make nominal transition |
| 0 | 1 | 1 | n | n | m | n | Extend pel 3 on right |

In the above table, n and m represent the values of two different arbitrary pels and, as before, a left to right scan of the CRT is assumed. The nominal transition referred to is between pels 3 and 2.

According to the pattern decoded by the AND gates 30 to 33, one of three clocking latches is set, an 'early' clocking latch 34, a 'nominal' clocking latch 35, or a 'late' clocking latch 36. These latches clock the output stage 44 of the shift register 40 to 44, selectively according to whether the transition between pels 2 and 3 is to remain in a nominal position, or advanced or delayed relative to such position.

In the first pattern above pel 2 is a critical feature with room for extension on the left and so the 'early' clocking latch 34 is set. In the second pattern both pels 2 and 3 are critical features and so the transition between them is left in its nominal position, i.e. the "nominal" clocking latch 35 is set. The third pattern contains a single transition with no critical features and this is again left in its nominal position. Finally, in the last pattern pel 3 is a critical feature with room for extension on the right and so the 'late' clocking latch 36 is set.

It is clear that at most one clocking latch can be set in any per period since the four decoded patterns are mutually exclusive. Also, there is no need to decode the other four possible bit patterns in the shift register 26 to 28 since these correspond to pel patterns which have no change in value between pels 2 and 3 making clocking of the video output stage 44 redundant.

Each of the clocking latches resets itself after one gate delay so that they generate narrow clock pulses with a nominal width of about 3 nSecs. These pulses then propagate through one, two or three OR gates 37 to 39 to clock the video output stage 44. The delay through the shift register 26 to 28, the AND gates 30 to 33 and the clocking latches 34 to 36 is compensated by the three shift register stages 41, 42 and 43 in the video data path, so that the relevant pel transition (between pels 2 and 3) is present at the input of the final stage 44 when the latter is clocked by the selected one of the latches 34 to 36. However, the intermediate shift register stages 41 to 43 are not strictly necessary and an alternative form of delay means may be used between the input and output stages 40 and 44 if desired.

The result is that according to which of the latches 34 to 36 is set a transition at the output of the shift register stage 43 is clocked early to the output of the stage 44 via one gate delay (gate 37), in its nominal position via two gate delays (gates 37, 38), or late via three gate delays (gates 37, 38, 39). The OR gates 37 to 39 are selected to have a nominal delay of 2 nSec each so that any pel, initially of 10 nSec duration, can be extended to 12 or 14 nSec according to whether one or both edges are shifted.

It is to be understood that, while described for multi-bit video, the principles of operation of this second circuit are equally applicable to single bit (black and white) video.

What is claimed is:

1. A video display system of the kind in which at least one visible characteristic of consecutive image points on the screen of a raster-scan CRT is defined by the values of consecutive pels of a digital video drive waveform, each such pel comprising one or a plurality of video bits in parallel, and in which a pulse stretching circuit is provided for extending the duration of selected pels in the video waveform in order to at least partially compensate for image distortion introduced by the finite video amplifier rise and fall times of the CRT, characterized in that the pulse stretching circuit comprises, decoding means for examining each pel at least in relation to its two immediate neighbors on either side in order to detect predetermined relationships between the values of the pels, and retiming means for selectively advancing or delaying the time of transitions between consecutive pels of different value in accordance with the relationships so detected.

2. A system as claimed in claim 1, wherein the decoding means comprises means for comparing each pel with its immediate successor, a shift register for storing the result of each comparison together with the results of a plurality of immediately preceding comparisons, and a logic circuit connected to the shift register stages, and wherein the retiming means comprises a delay path for the waveform having an output register and means responsive to the logic circuit for clocking the output register at a predetermined time in relation to non-selected transitions, earlier than the said predetermined time in relation to transitions selected for advancement, and later than the said predetermined time in relation to transitions selected for delay.

3. A system as claimed in claim 1, wherein each pel in the digital video drive waveform consists of one bit, wherein the decoding means comprises a shift register for the waveform and a logic circuit connected to the shift register stages, and wherein the retiming means comprises a delay path for the waveform which includes a fixed path through part of the shift register and a variable path through part of the logic circuit, the variable path through the logic circuit including a predetermined number of logic components for non-selected transitions with the number of logic components in the path being decreased in respect of transitions selected for advancement and increased in respect of transitions selected for delay.

4. A system as claimed in any preceding claim, wherein the decoding means is arranged to detect isolated pels which have a value different from their immediate neighbors on either side and which are immediately preceded or succeeded by at least two consecutive identical pels, and wherein the retiming means is arranged to advance the leading edge and/or delay the trailing edge of each such pel according to whether the latter is preceded and/or succeeded by the said at least two consecutive identical pels.

* * * * *